US005850876A

United States Patent [19]

Allison et al.

[11] Patent Number: 5,850,876

[45] Date of Patent: Dec. 22, 1998

[54] APPARATUS AND SYSTEM FOR THE STORAGE AND SUPPLY OF LIQUID $CO_2$ AT LOW PRESSURE FOR EXTINGUISHING OF FIRES

[75] Inventors: James H. Allison, Brisbane; Ian R. Tronc, Goldcoast; Peter Dunn, Brisbane, all of Australia

[73] Assignee: Pyrozone Pty. Ltd., Queensland, Australia

[21] Appl. No.: 725,821

[22] Filed: Oct. 7, 1996

(Under 37 CFR 1.47)

Related U.S. Application Data

[63] Continuation of Ser. No. 462,553, Jun. 5, 1995, abandoned, which is a continuation of Ser. No. 920,505, filed as PCT/AU91/00006, Jan. 8, 1991, abandoned.

[30] Foreign Application Priority Data

| | | | |
|---|---|---|---|
| Jan. 8, 1990 | [AU] | Australia | PJ 8118 |
| Mar. 2, 1990 | [AU] | Australia | PK 0262 |
| May 3, 1990 | [AU] | Australia | PJ 9933 |

[51] Int. Cl.[6] ..... A62C 37/44

[52] U.S. Cl. ..... 169/61; 169/11

[58] Field of Search ..... 169/5, 11, 51, 169/52, 61; 62/47.1; 222/3, 6

[56] References Cited

U.S. PATENT DOCUMENTS

| | | | |
|---|---|---|---|
| 2,202,343 | 5/1940 | Geertz | 169/11 |
| 2,287,873 | 6/1942 | Geertz et al. | 169/11 X |
| 2,356,990 | 8/1944 | Getz | 169/11 |
| 2,482,778 | 9/1949 | Joerren | 137/212 |
| 2,529,127 | 11/1950 | Beach | 169/9 |
| 2,534,262 | 12/1950 | Heigis et al. | 222/6 X |
| 2,544,016 | 3/1951 | Getz | 169/11 |
| 3,016,956 | 1/1962 | Olandt | 169/11 |
| 3,497,012 | 2/1970 | Williamson | 169/11 X |
| 4,589,077 | 5/1986 | Pope | 73/304 C X |
| 4,991,402 | 2/1991 | Saia, III | 62/239 X |
| 5,177,974 | 1/1993 | Uren et al. | 62/47.1 |

FOREIGN PATENT DOCUMENTS

| | | |
|---|---|---|
| 232750 | 8/1927 | United Kingdom . |
| 509101 | 7/1939 | United Kingdom . |
| 586291 | 4/1947 | United Kingdom . |
| 784734 | 10/1957 | United Kingdom . |
| 90/08304 | 7/1990 | WIPO . |

*Primary Examiner*—Andrew C. Pike
*Attorney, Agent, or Firm*—Nixon & Vanderhye P.C.

[57] ABSTRACT

An apparatus and system stores and supplies liquid $CO_2$ at low pressure for extinguishing fires. The apparatus comprises a pressure vessel (13) for storing liquid $CO_2$ at low pressure, a cooling device (29) in contact with gaseous $CO_2$ in the vessel to maintain the low pressure, an inlet (24) and outlet (32) to fill the vessel and a supply conduit (17) communicating with a lower portion of the interior of the vessel to allow liquid $CO_2$ to pass from the vessel and into a reticulation system. A number of pressure vessels can be coupled together through a manifold (165) to provide the required amount of liquid $CO_2$ to a risk site. Supply valves (18) or manifold valves (173, 174) can be operated by a sensor (175, 176) in a risk site and a logic processor (177) can be used to regulate the valves and thereby the liquid $CO_2$. The apparatus and system is particularly designed as a replacement for current halon systems which cause damage to the ozone layer.

8 Claims, 9 Drawing Sheets

APPARATUS AND SYSTEM FOR THE STORAGE AND SUPPLY OF LIQUID $CO_2$ AT LOW PRESSURE FOR EXTINGUISHING OF FIRES

RELATED APPLICATIONS

This is a continuation of application Ser. No. 08/462,553, filed Jun. 5, 1995, now abandoned, which in turn, is a continuation of application Ser. No. 07/920,505, filed as PCT/AU91/0006, Jan. 8, 1991, now abandoned.

FIELD OF THE INVENTION

This invention relates to an apparatus and system for the storage and supply of liquid $CO_2$ at low pressure for extinguishing fires and has particular use for extinguishing and prevention of electrical fires or fires for which water is not suitable as an extinguishing medium.

BACKGROUND OF THE INVENTION

The most common types of fire protection systems for buildings such as high rise office blocks and the like comprise water sprinklers and water fire hoses. The sprinklers and hoses are connected to an array of pipes extending throughout the building. Water is provided under pressure into the pipes by a central water source such as mains water and for high rise buildings it is necessary to have expensive and complex pumps associated with the mains water to ensure that the water can be pumped through all the water pipes at sufficient speed and pressure to provide a satisfactory discharge of water through the sprinklers.

The pump is generally powered by an internal combustion engine, the pump and engine being located in a basement and connected to the local water mains. Apart from the very high installation and maintenance costs, such systems become ineffective in the event that the basement is flooded or if the water main is fractured due to an explosion, earthquake and the like.

There are serious disadvantages associated with the use of water as a fire extinguishing medium. The most serious disadvantage is the damage caused by water itself. For instance, in an office building, a small localized fire may set off one or more water sprinklers resulting in water being discharged over a wide area. Water itself can be severely damaging to computer equipment, furnishings, files, carpets, and the like. Furthermore, once the water has been discharged from the sprinklers, the water leaks to lower floors which in turn causes similar damage even though the lower floors were not at risk from fire damage.

Another disadvantage with water is its inherent corrosive nature resulting in the requirement for frequent inspections of the sprinkler pipeline, nozzles, and the associated pump equipment.

Finally, water is an unsatisfactory fire extinguishing medium for electrical fires, fires involving flammable liquids, fires involving plastics material such as furnishings, carpets, and sound and heat insulation, and fires which are within an enclosed compartment (such as a computer terminal) where water cannot penetrate into the compartment.

In order to overcome the problems associated with water sprinklers, it is known to use $CO_2$ as a fire extinguishing medium. $CO_2$ is suitable for use in computer installations, electrical and communication switchboards, records, storage installations, and the like.

Hitherto, these fire extinguishing systems have used $CO_2$ under high pressure. The $CO_2$ is stored and supplied from high pressure steel cylinders designed to withstand an internal pressure of approximately 14,000 KPa. These steel cylinders must be strong enough to contain such pressures and therefore the cylinders weigh approximately 136 kg each when full but contain only about 46 kg of $CO_2$. Each cylinder stands about 1.5 meters in height and has a diameter of about 0.25 meters.

The standards governing the use of $CO_2$ as a fire extinguishing medium require certain amounts of $CO_2$ be discharged into a risk site within a particular time period in order to provide an effective fire reduction or extinguishing effect. For risk sites including an office space or computer room, the amount of $CO_2$ required necessitates the use of a battery of such high pressure cylinders connected to a manifold. For instance, a risk site which requires 500 kg of $CO_2$ necessitates a battery of at least 12–17 steel cylinders each connected to a common manifold. A severe disadvantage with this system is that such a battery occupies a large amount valuable space; and due to the weight of a battery of 12–17 steel cylinders each weighing 136 kg, there is a requirement to have special reinforcing in the floor supporting these cylinders.

Another disadvantage in the use of high pressure steel cylinders is that the cylinders cannot be filled on site and must be decoupled from the manifold and transported to a central filling site and then returned and reattached to the manifold. This creates a considerable maintenance requirement for a large number of such cylinders and results in wear and tear on the couplings between a cylinder and the manifold.

Another disadvantage is that it is not possible to accurately determine the volume within each cylinder and whether or not any cylinder needs replacement and therefore periodic removal and inspection of the cylinders are required again adding to maintenance costs and resulting in a "risk" window occurring when a cylinder or cylinders are removed from the manifold.

A further disadvantage with the use of high pressure cylinders is that their requirement for a large amount of space normally results in the cylinders being situated outside the building or in a basement. Thus, extensive pipework is necessary to ensure that the high pressure gas can be conveyed from the remotely located cylinders to the risk area. This in turn adds to the cost of the fire extinguishing system, and the possibility of leaks occurring between the large number of couplings required between adjacent pipes.

A further disadvantage with the use of high pressure $CO_2$ is that the pipes and nozzles which convey the $CO_2$ to a risk site and discharge the $CO_2$ in to the risk site must be of sufficient strength to withstand the high pressures. This requires more expensive pipe work and careful joining of adjacent pipes together. The diameter of the pipe work is small to withstand the working pressures and this results in friction losses in the system.

A second known fire extinguishing system utilises halon gases as the fire extinguishing medium. Halon gases comprise bromine compounds as well as chlorine compounds both of which are believed to damage the ozone layer. The bromine compounds are thought to be even more hazardous than the chlorine or chlorine/fluorine compounds because they can cause damage by reacting with ozone even without sunlight and oxygen.

A particular advantage of halon is that it functions under low pressures of 350 psi therefore allowing low pressure pipeline to convey the halon from a halon storage cylinder to a discharge nozzle in a risk site.

Halons are currently being phased out of use in situations where the halon gas is dissipated as is the case with halon fire extinguishing systems.

Our earlier International patent application WO8804007 disclosed a storage system for storing liquid $CO_2$ at low pressure. The storage system included a pressure vessel having an internal cooling means located in the region normally occupied by gaseous $CO_2$ to maintain the low pressure within the pressure vessel and included a supply conduit to supply gaseous $CO_2$ from the pressure vessel. The gaseous $CO_2$ was used principally in the hotel trade for the provision of carbonated beverages. It was essential that the $CO_2$ being withdrawn from the pressure vessel was in the gaseous state so that a supply of gaseous $CO_2$ at a constant pressure could be obtained.

This vessel was unsuitable for supplying liquid $CO_2$ at low pressure as the supply conduit was arranged such that only gaseous $CO_2$ was discharged from the vessel. In fire extinguishing systems utilising $CO_2$ either at high pressure or at low pressure, it is critical to ensure that liquid $CO_2$ passes into the associated pipeline and through the discharge nozzles so that the greatest rate of $CO_2$ transfer can be achieved. If only gaseous $CO_2$ was passed through the pipelines, only a fraction of the amount of $CO_2$ could be passed into a risk area unless extremely high pressures were used in which case there would be considerable damage in the risk area due to the explosive exit of gaseous $CO_2$ from the discharge nozzles. This would require extremely high strength pipework and discharge nozzles which would be impractical. Furthermore, the National Fire Protection Agency Code (NFPA) which is an International code requires liquid $CO_2$ to be passed into the reticulation system.

U.S. Pat. No. 3,282,305 to Antolak discloses a cylinder filling apparatus. The apparatus includes a large non-portable main tank or reservoir containing liquid $CO_2$ maintained at low temperatures by means of refrigerator coils through which circulates a supply of brine or other suitable coolant supplied by an externally located refrigeration apparatus. The main tank has an outlet located at the bottom of the tank through which liquid $CO_2$ can be discharged into an arrangement to allow high pressure cylinders to be filled. A recycling inlet pipe locates in a upper portion of the tank to recycle gaseous $CO_2$.

There is no disclosure of the tank having an inlet means and outlet means for filling the vessel and furthermore there is no ability to accurately determine the liquid level within the vessel. A further disadvantage is that the tank is heavy and is of a non-portable construction and would again be needed to be placed at a site remote from a risk area and on reinforced foundations. Furthermore, such tanks generally have an elongate configuration and are required to be supported horizontally due to their size. For efficient cooling of the gas, it is necessary for a sufficient gap to be present between the liquid level and the upper wall of the tank and this results in an undesirable reduction of available liquid space within the tank.

It is an object of the invention to provide an apparatus and system for storing and supplying liquid $CO_2$ at low pressure for fire extinguishing and which may alleviate the above-mentioned disadvantages.

DISCLOSURE OF THE INVENTION

In one form, the invention resides in in a fire extinguishing system comprising a pressure vessel for storing and supplying liquid $CO_2$ at low pressure, said pressure vessel including a supply conduit for supplying liquid $CO_2$ said supply conduit communicating with a lower portion of the pressure vessel normally occupied by liquid, a conveying conduit in fluid communication with the supply conduit for conveying low pressure $CO_2$ from the pressure vessel to a risk site and extending into the risk site, and one or more discharge nozzles coupled to said conveying conduit to allow passage of $CO_2$ from the conduit into the risk site.

In another form the invention resides an apparatus for storing and supplying liquid $CO_2$ at low pressure and for extinguishing fires the apparatus comprising a pressure vessel for storing the liquid $CO_2$ and having a top wall and a bottom wall, inlet means and outlet means in communication with the interior of the pressure vessel for filling the vessel, cooling means in contact with gaseous $CO_2$ from the vessel, and supply conduit for supply of liquid $CO_2$, said supply conduit communicating with the interior of the vessel adjacent the bottom wall of the vessel.

The term "low pressure" as it relates to storage of liquefied gas according to the invention includes pressures in the order of about 1,000–4,000 KPa.

Conversely, "high pressure" as it relates to the storage of liquefied gas according to the prior art includes pressures in the order of about 7,000–20,000 KPa.

The cooling means may be located within the vessel in an upper part thereof in a region normally occupied by gas and may comprise any means for cooling the gaseous form of $CO_2$ such as any suitable heat exchange means such as an evaporator associated with a compression or absorption refrigeration apparatus.

The evaporator suitably comprises one or more evaporator coils which can extend through the top wall of the pressure vessel and can be supported thereby. This arrangement allows the side wall and the bottom wall of the pressure vessel to be formed without any requirement for drilling or otherwise forming apertures in these areas.

Alternatively, the pressure vessel and particularly a number of pressure vessels can be in gaseous communication with a separate chamber which houses the cooling means thereby allowing the gas in the or each pressure vessel to be cooled.

The refrigeration apparatus may be supported by the pressure vessel and suitably is mounted adjacent the top wall of the pressure vessel above the evaporator coils to allow for a compact design.

The inlet means suitably comprises one or more lengths of conduit which can extend through the top wall of the pressure vessel and through the interior of the pressure vessel to a position adjacent the bottom wall. Suitably, the lower end of the conduit is formed with an inclined opening such that the end of the conduit may abut against the bottom wall of the pressure vessel while still allowing $CO_2$ to pass into the conduit. An advantage of having the inlet means in this configuration is that any incoming gas can percolate through and be cooled by the liquid $CO_2$ in the tank. The contents of the tank can also be pumped out through the inlet means without requiring $CO_2$ to pass through the supply conduit.

The inlet means may alternatively be positioned in an upper portion of the pressure vessel normally occupied by gas. In this configuration, the inlet means may be positioned such that incoming fluid is sprayed over or through the gas existing in the pressure vessel. The gaseous component of the incoming fluid may drift down and mix with the cooler existing gas in the system while the sub-cooled liquid component of the incoming fluid condenses some of the existing gas as it falls to the surface of any existing liquid in the vessel. This may assist in maintaining the working pressure in the vessel by correcting for the incoming gas.

The inlet means may also be positioned such that incoming fluid is sprayed over or contacts against the cooling means.

The outlet means may comprise one or more lengths of conduit which may extend through the top wall of the pressure vessel and into a region normally occupied by gas. Alternatively, the conduit may extend through the interior of the vessel to a lower position in a region normally occupied by the liquid.

The inlet means and outlet means may comprise a common conduit.

The supply conduit suitably includes a supply valve to regulate passage of liquid $CO_2$ from the cylinder. The supply valve may be manually operable or operable by a remote sensor. To compensate for the low pressure in the pressure vessel, the supply conduit suitably has an internal cross-sectional size larger than that of a corresponding high pressure vessel to allow a similar volume of liquid $CO_2$ to exit from the vessel. Alternatively, a "booster" source of high pressure such as an auxiliary high pressure vessel may be provided.

The apparatus suitably includes a liquid level indicating means. The liquid level indicating means may be the same as disclosed in our earlier International patent application. Alternatively, the liquid level indicating means may comprise a probe having a plurality of spaced thermoresponsive transistors whose electrical current capacity changes as a function of the heat transfer rate of the respective gas and liquid phases of the liquid $CO_2$. A suitable level indicating means of this type is described in PCT Application No. PCT/AU91/00535 published 25 Jun. 1992 as WO92/09867. In a further alternative, the probe may comprise one or more oscillators which are activated or deactivated in the presence of a liquid gas as a function of the change in the dielectric constant between the gas and liquid phases.

The liquid level indicating means preferably extends through the top wall of the pressure vessel and may extend to adjacent the bottom wall of the vessel to allow the liquid level to be determined at all levels within the vessel.

Suitably, the liquid level indicating means locates within a housing, the housing extending through the top wall of the pressure vessel and into the pressure vessel. In this manner, the liquid level indicating means can be periodically removed for inspection and/or replacement without disrupting the sealing integrity of the pressure vessel.

A further cooling means may be associated with the inlet means to cool the fluid prior to entering into the pressure vessel. This further cooling means may be located adjacent the exterior of the pressure vessel and in the heat exchange relationship with the conduit comprising the inlet means.

The apparatus may include a pressure release valve in the event of excess pressure build-up due to refrigeration system failure, excess filling, or the like. The pressure release valve may be connected adjacent one end of a conduit which may extend through the top wall of the pressure vessel or alternatively may be associated with the outlet means.

Suitably, the apparatus includes one or more sensors to sense variations from predetermined parameters and to activate a warning if a variation is sensed.

The sensors typically include a high pressure sensor, a low pressure sensor, an overfill sensor, an underfill sensor, a power failure sensor, or any combination of the above.

The pressure sensors suitably comprise pressure switches in gaseous communication with the pressure vessel and typically are in communication with the conduit to which the pressure release valve is connected.

The fill sensors are suitably activated by a level indicating means.

The or each sensor may be coupled to a central computing means or via a telephonic system to a remote station which can thereby monitor the parameters of the pressure vessel.

The apparatus may include a heating means in a heat exchange relationship with the interior of the pressure vessel. The heating means may be located within the lower portion of the pressure vessel in a region normally occupied by liquid. Alternatively, the heating means may be located externally of the pressure vessel and in a heat exchange relationship therewith. The heating means may be heated by waste heat from a condenser associated with the cooling means. Alternatively, the heating means may be electrically energised. Suitably, the heating means comprises a heating element located within a housing which housing is positioned in a lower portion of the pressure vessel and in a heat exchange relationship with fluid in the vessel. Alternatively, the heating means may comprise one or more heating elements positioned about the periphery of the pressure vessel. The heating element may comprise one or more heating pads or a heating strip, tape, or element which can be wound about the external periphery of the pressure vessel. Suitably, the elongate housing which houses the heating means extends through the top wall of the pressure vessel and through the pressure vessel to a position adjacent the bottom wall of the pressure vessel. Alternatively, the housing extends through a side wall of the pressure vessel. An advantage of the housing is that the heating means can be removably located within the housing allowing periodic inspection and/or replacement of the heating means without disrupting the sealing integrity of the pressure vessel. In yet a further alternative, the heating means may be in a heat exchange relationship with an external conduit one end of which passes into a lower portion of the vessel normally occupied by liquid and the other end of which passes into an upper area of the vessel normally occupied by gas. A further heating means may be associated with the supply conduit which supplies the liquid $CO_2$.

The apparatus may include a high pressure fluid storage container (having a pressure greater than 8,000 KPa) and suitably comprises a conventional high pressure gas cylinder. The high pressure fluid storage container may function to pressurize the pressure vessel to facilitate passage of liquid $CO_2$ through the supply conduit. The high pressure fluid storage container is suitably connected to the interior of the low pressure container by fluid conduit. Suitably, a valve means is associated with the fluid conduit and detection means responsive to conditions associated with a fire is provided, the detection means in use being operable to open said valve means to allow the high pressure fluid to flow from the high pressure storage container to the pressure vessel.

The valve means suitably comprises a mechanical actuation means, thermally responsive actuation means, a fluid pressure actuation means, and electromechanical actuation means, or a combination thereof.

The detection means may comprise any suitable means for detecting or sensing conditions associated with the presence of fire. The detection means may be responsive to infrared radiation, gaseous combustion products, or both. A suitable detection means comprises a fusible element, a thermally responsive element, or the like.

The fire extinguishing system suitably comprises a pressure vessel as described above with the supply conduit of the pressure vessel being in fluid communication with the conveying conduit to convey the $CO_2$ from the pressure vessel to the risk site Suitably, a plurality of the pressure vessels are coupled to a common manifold. The pressure vessels may be in constant fluid communication with the manifold thereby pressurizing the manifold or alternatively each pressure vessel may include a supply valve associated with the supply conduit to control the passage of $CO_2$ into the manifold. The supply valve may be operable from a closed position to an open position manually or by a sensor covering a risk site.

The conveying conduit to convey the $CO_2$ from the pressure vessel to the risk site is suitably connected to the manifold. Preferably, the conveying conduit is coupled to the manifold through a manifold valve. The manifold valve may be operable from a closed position to an open position either manually or by a sensor covering a risk site.

A number of conveying conduits may be coupled to the manifold to convey liquid $CO_2$ to a number of risk sites or to various parts within a risk site.

Suitably, each of the pressure vessels includes a supply valve which can be separately operated by one or more sensors which may be located in a single risk site or a plurality of separate risk sites.

Each of the sensors may be linked to a computing means which computes the volume of the risk site controlled by each of the sensors and actuates one or more supply valves of one or more pressure vessels and one or more manifold valves (if present) to convey the required amount of liquid $CO_2$ towards the risk site or sites. The computing means suitably comprises a logic processor.

The conveying conduit may comprise a primary conduit to convey $CO_2$ from the pressure vessel towards a risk site or a plurality of risk sites and a plurality of secondary conduits each extending from the primary conduit and extending through the risk site. The secondary conduits suitably include one or more discharge nozzles to discharge the $CO_2$ into the risk site.

In order to maintain a substantially constant discharge pressure from each discharge nozzle, the primary and/or secondary conveying conduit may decrease in cross-sectional size along its length.

The discharge nozzles preferably comprise an upper substantially spherical body which is connected to the conveying conduit, and a lower outlet having a substantially conical configuration and a spigot communicating with the interior of the conveying conduit and extending into the upper main body and having one or more openings to discharge $CO_2$ from the conveying conduit and against the side walls of the upper main body, the $CO_2$ subsequently passing through the lower outlet and into the risk site.

DISCLOSURE OF THE DRAWINGS

The invention will be described with reference to the following description of embodiments thereof in which.

Figure 15:
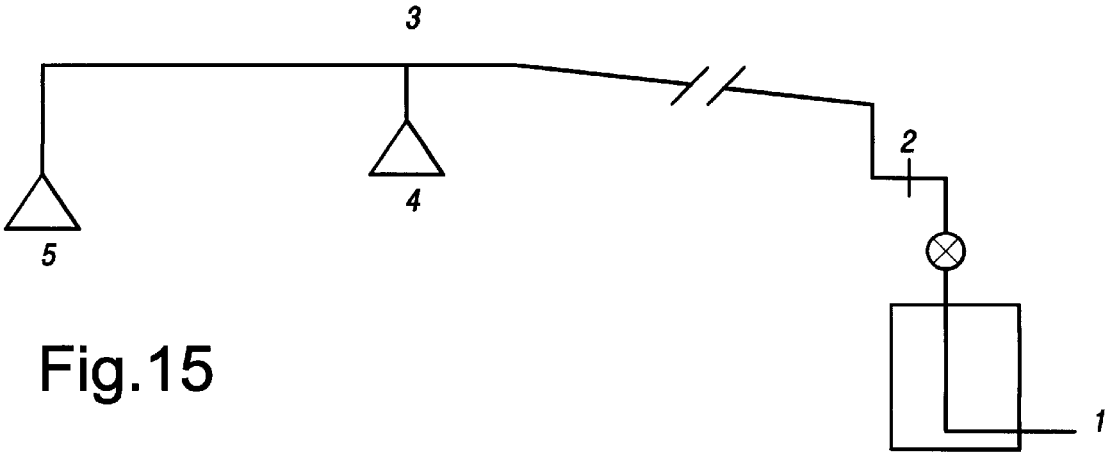

FIG. 15 discloses an existing layout of a fire extinguishing system.

DETAILED DESCRIPTION OF THE INVENTION

Figure 1:
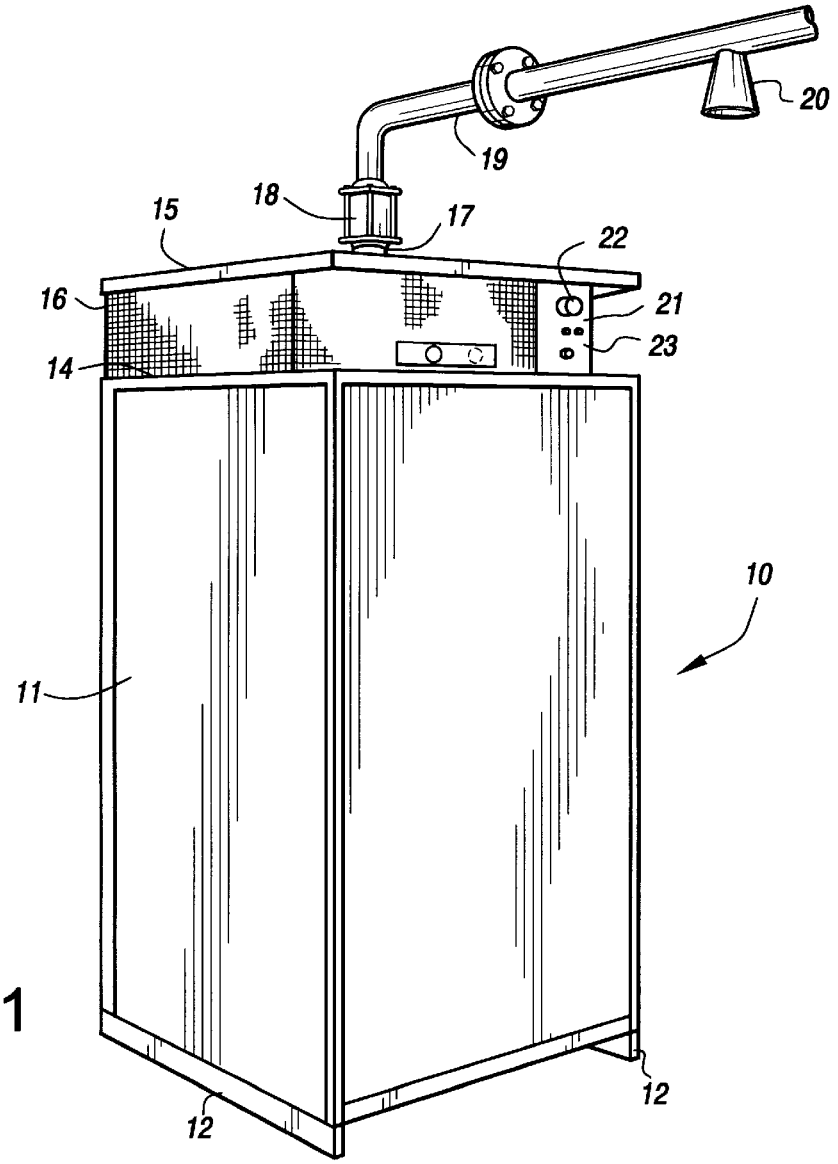
FIG. 1 is a perspective view of an apparatus according to an embodiment of the invention.

FIG. 1 discloses an apparatus for storing and supplying liquid $CO_2$ at low pressure for use in extinguishing fires. The apparatus 10 comprises an outer cabinet 11 which can be manufactured from metal or plastics material. The base of outer cabinet 11 is raised from a floor portion by spacers 12 to allow times of an elevating apparatus to pass between spacers 12 thereby allowing the apparatus to be transported.

Figure 2:
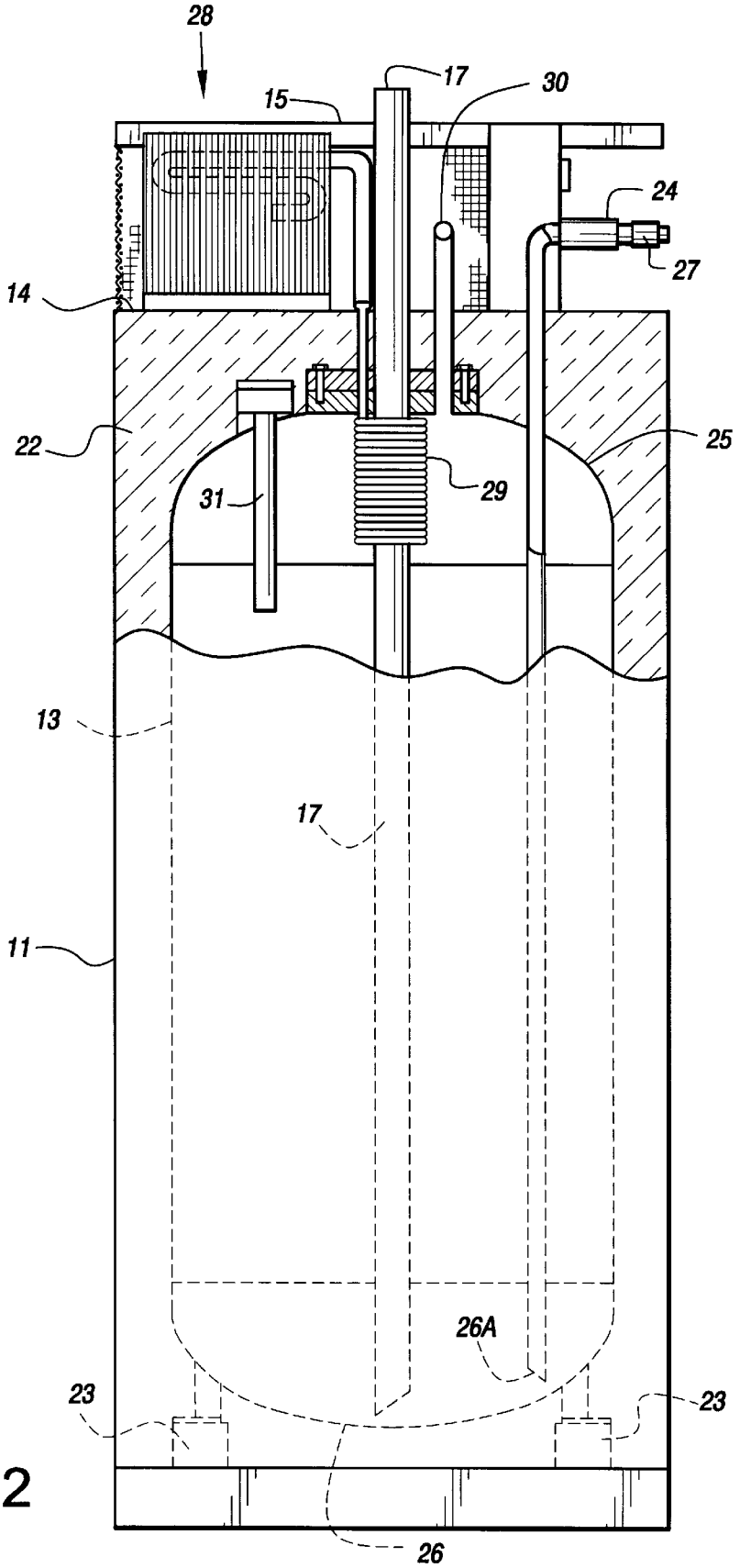
FIG. 2 is a partial cross-section of the apparatus of FIG. 1.
Figure 5:
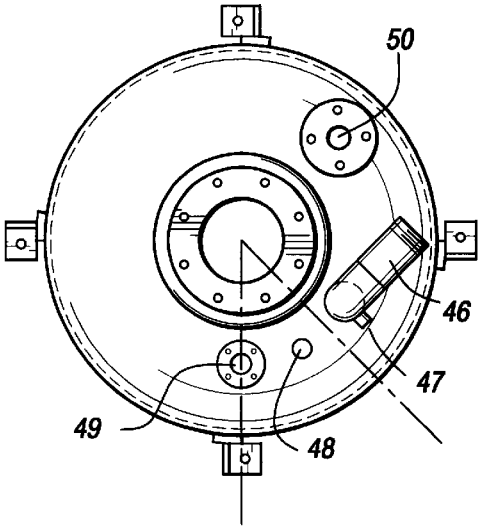
FIG. 5 is a plan view of the apparatus of FIG. 4.

Outer cabinet 11 houses a pressure vessel 13 (more clearly shown with reference to FIG. 2). Outer cabinet 11 includes a top wall 14 and an upper shield 15 to protect the associated components located on top wall 14 against damage. A steel mesh 16 connects upper shield 15 with top wall 14 to prevent damage to the various components located in this area.

The apparatus includes a supply conduit 17 which extends through an opening in upper shield 15 and which terminates with a supply valve 18 as more clearly described below. Supply valve 18 can be actuated manually or remotely by a remote sensor.

As illustrated in FIG. 1, apparatus 10 is coupled to a conveying conduit 19 which includes a typical discharge nozzle 20.

A front panel 21 houses various pressure gages 22 and alarms 23 to indicate the various conditions within the tank or apparatus.

Referring to FIG. 2, tank 13 is surrounded by insulating material 22 which in the embodiment comprises polyurethane foam. A vapour seal (not shown) is provided around Insulating material 22 which typically comprises a bituminous or pitch-like material.

Tank 13 is supported within outer cabinet 11 by feet 23.

Tank 13 comprises an inlet means 24 which comprises a suitable pipe extending through the top wall 25 of tank 13 and to adjacent a bottom wall 26 of tank 13. The lower end of pipe 24 is formed with an inclined opening 26A such that if pipe 24 abuts against bottom wall 26, an opening is still provided to allow fluid flow through pipe 24. The upper end of pipe 24 is provided with a conventional quick connect coupling assembly 27 to allow the pipe to be coupled to a supply of $CO_2$.

Tank 13 also includes an outlet means in the form of a pipe (not shown) which extends into an upper portion of tank 13 normally occupied by gas and is also formed with a conventional quick connect coupling assembly as is the case with pipe 24.

The apparatus further comprises a cooling means in the form of a refrigeration apparatus 28 and an evaporator coil 29 located within tank 13 in an upper part normally occupied by gas. Refrigeration apparatus 28 is supported by top wall 14 of cabinet 11 and evaporator coil 29 extends through an opening in the top wall 25 of pressure vessel 13 and extends about supply conduit 17. It should be appreciated however that this particular arrangement of evaporator coil 29 is for convenience only.

A pressure release valve 30 extends through top wall 25 of pressure vessel 13 and allows excess pressure to vent from the apparatus.

The supply conduit 17 extends through top wall 25 and terminates adjacent bottom wall 26 of pressure vessel 13. The lower end of supply conduit 17 is formed with an inclined opening to facilitate movement of liquid $CO_2$ into the conduit. Supply conduit 17 extends through upper shield 15 and may be associated with a supply valve more clearly shown with reference to FIG. 1.

The pressure vessel 13 includes a liquid level indicating means 31 in the form of a probe having a plurality of spaced thermoresponsive transistors. Probe 31 extends partially into the vessel 13 to allow measurement of the liquid level when the tank is full or 90% full. Of course probe 31 could extend through vessel 11 to adjacent bottom wall 26 to allow all levels in the vessel to be measured.

Figure 3:
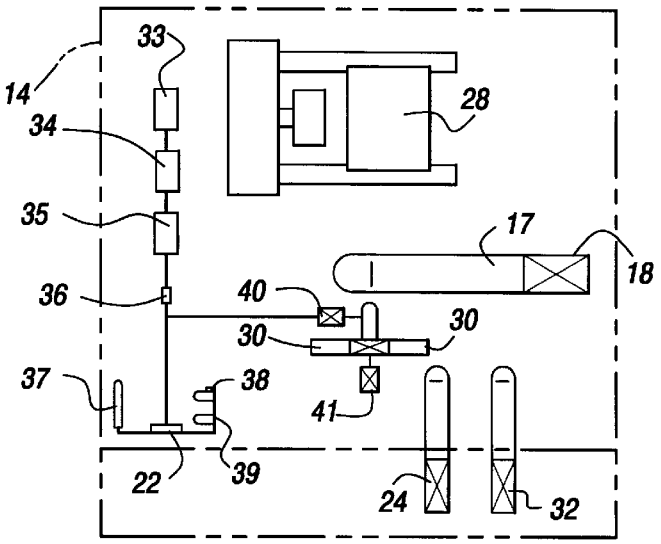
FIG. 3 is a diagrammatic plan view of the apparatus of FIG. 2.

An apparatus for storing and supplying 500 kg of $CO_2$ has the following or equivalent unit specifications:

Material: Shell AS1548-7-460R Boiler plate
N plates/heads: AS1548-7-460R Boiler plate
Nozzles: 15 mm-20 mm-50 mm NBGR106B pipe
Working pressure: 2,000–2,200 KPa
Design Pressure: 2,380 KPa
Test Pressure: 3,600 KPa
Working temperature: −17° C.
Pressure Release Valve: Hydrostatic relief valve
Safety Valve Setting: 2,400 KPa
Supply Valve: 2 Inch BSPT lockable ball valve
Control Valve Supply Regulator: Inlet-2,000 KPa, Outlet-700 KPa
Refrigeration Unit: 200 W at −25° C.
Condensing Unit Capacity:
Refrigerant: R22 (Freon)
Dimensions: Width-950 mm×950 mm Height-2,000 mm
Tare Mass: 459 kg
Level Indication: 100% fill 525 kg 90%-472 kg
Insulation: Closed cell polyurethane
Supply Connections: 1¼ Inch BSPT female
Liquid Fill: ¾ Inch quick connect coupling
Vapour Return: ½ Inch quick connect coupling
Supply Line: 2 Inches BSPT
High Pressure Alarm: 2,300 KPa (auto reset)
Low Pressure Alarm: 1,900 KPa (auto reset)
Pressure Gauge: 0–4,000 KPa FIG. 3 discloses diagrammatically the layout of various components supported by top wall 14. The Figure shows the positioning of refrigeration apparatus 28, inlet pipe 24 and the outlet vapour return pipe 32, supply conduit 17, supply valve 18, refrigeration pressure switch 33, high pressure switch 34, low pressure switch 35, gage link test connector 36, printed circuit board 37, visual pressure gage 22, refrigeration control relay 38, power failure relay 39, gage line isolating valve 40, discharge valve control connection 41, and pressure relief valves 30. It should be appreciated that this particular layout is for convenience only and other layouts may be equally applicable.

Figure 4:
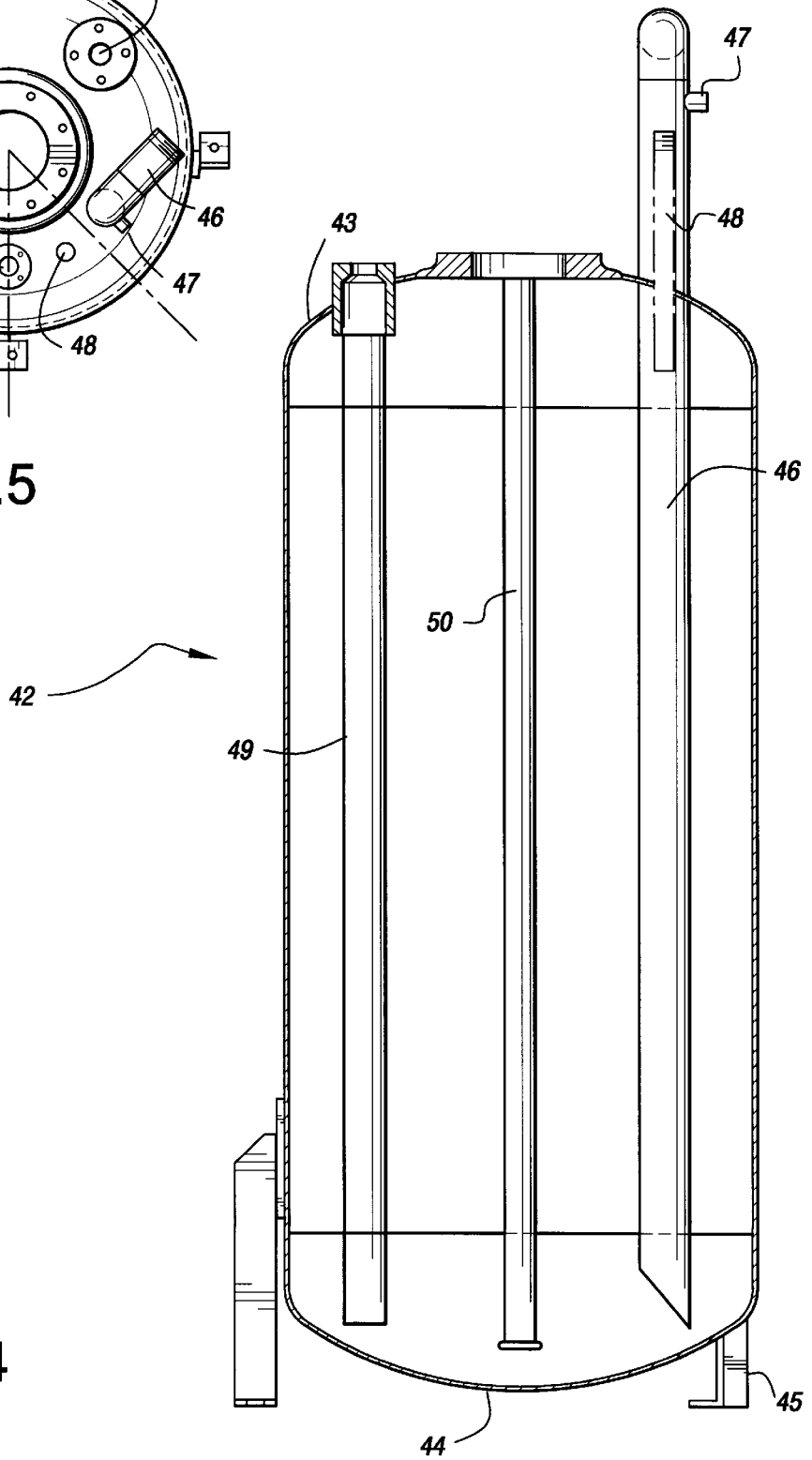
FIG. 4 is a cross-section view of an apparatus according to a second embodiment of the invention.

FIG. 4 discloses an alternative embodiment of the pressure vessel according to the invention. Pressure vessel 42 includes a top wall 43 and a bottom wall 44 and is supported by feet 45 from the bottom wall of a cabinet (not shown). In this embodiment, supply conduit 46 extends through one side of top wall 43 to adjacent bottom wall 44. Supply conduit 46 is formed with connector 47 located on conduit 46 externally of pressure vessel 42 and which can be coupled to a source of liquid $CO_2$. Coupling 47 thereby allows conduit 46 to function both as the supply conduit and the inlet means for filling the pressure vessel. An outlet means 48 is located spaced from supply conduit 46 and extends through top wall 43 to an upper portion of the pressure vessel normally occupied by gas. This particular arrangement minimizes the number of openings required to be formed or drilled into pressure vessel 42. A liquid level monitoring device 49 locates within pressure vessel 42 and extends to bottom wall 44 to allow accurate determinations of the liquid level. The pressure vessel of this embodiment includes a tubular housing 50 extending through vessel 42. Housing 50 can accommodate a removable heater (not shown) such as an element heater to allow the liquid contents of the tank to be heated.

Figure 6:
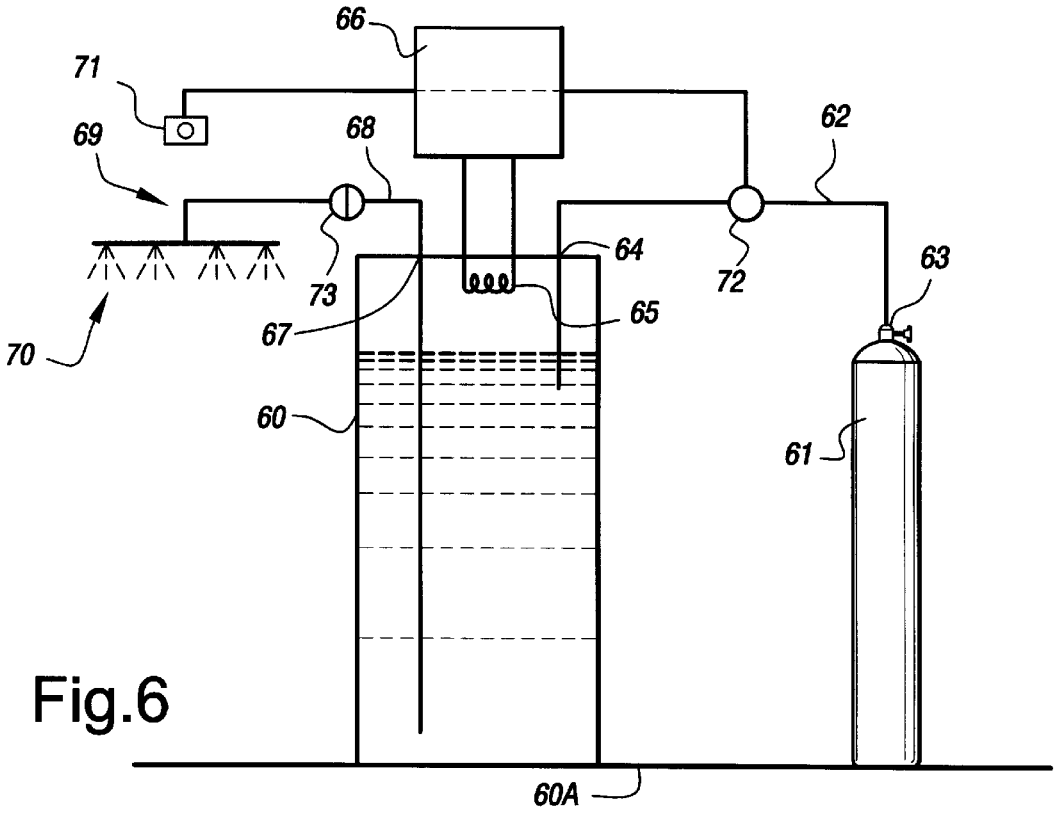
FIGS. 6 and 7 are schematic views of an apparatus according to an embodiment of the invention including a high pressure fluid storage container.

FIG. 6 discloses an apparatus according to an embodiment in the invention comprising pressure vessel 60 and a high pressure fluid storage vessel 61 in the form of a steel cylinder containing $CO_2$ at about 14,000 KPa. A conduit 62 connects outlet valve 63 of cylinder 61 to an inlet port 64 having an opening in the upper part of pressure vessel 60.

Pressure vessel 60 comprises an insulated storage vessel containing liquid $CO_2$ at a pressure in the range of 1,600 to 2,300 KPa. An evaporator 65 of a refrigeration system 66 is located above the level of liquid $CO_2$ in the region normally occupied by gas.

An outlet port 67 has an opening in pressure vessel 60 near the bottom wall 60A of vessel 60. Outlet port 67 is connected via supply conduit 68 to a reticulation system 69 having a plurality of discharge nozzles 70.

A fire detecting sensor 71 in the form of a thermal or gas sensing detector is operatively connected to a diaphragm valve or solenoid valve 72 in conduit 62.

A "burst" valve 73 is provided in conduit 68 to avoid leakage of $CO_2$ gas from within pressure vessel 60. Valve 73 comprises a frangible diaphragm adapted to fracture at a predetermined pressure when pressure vessel 60 is pressurized by high pressure gas from vessel 61.

In the event of a fire, sensor 71 which is responsive to a temperature in excess of a predetermined limit or in the presence of combustion gases actuates valve 72 to allow high pressure $CO_2$ to enter and pressurize pressure vessel 60. Liquid $CO_2$ contained within pressure vessel 60 is then forced under high pressure to reticulation system 69 and discharges from nozzle 70.

By utilizing relatively large diameter conduit for the reticulation of liquid $CO_2$ the entire contents of pressure vessel 60 may be evacuated rapidly as a liquid in the region of a fire where upon the liquid boils to form an instant gas blanket over the fire.

The capacity of high pressure cylinder 61 may be chosen to be sufficient to evacuate the liquid $CO_2$ from pressure vessel 60 or it may have an excess capacity to provide a continued release of $CO_2$ gas into the region of the fire.

Figure 7:
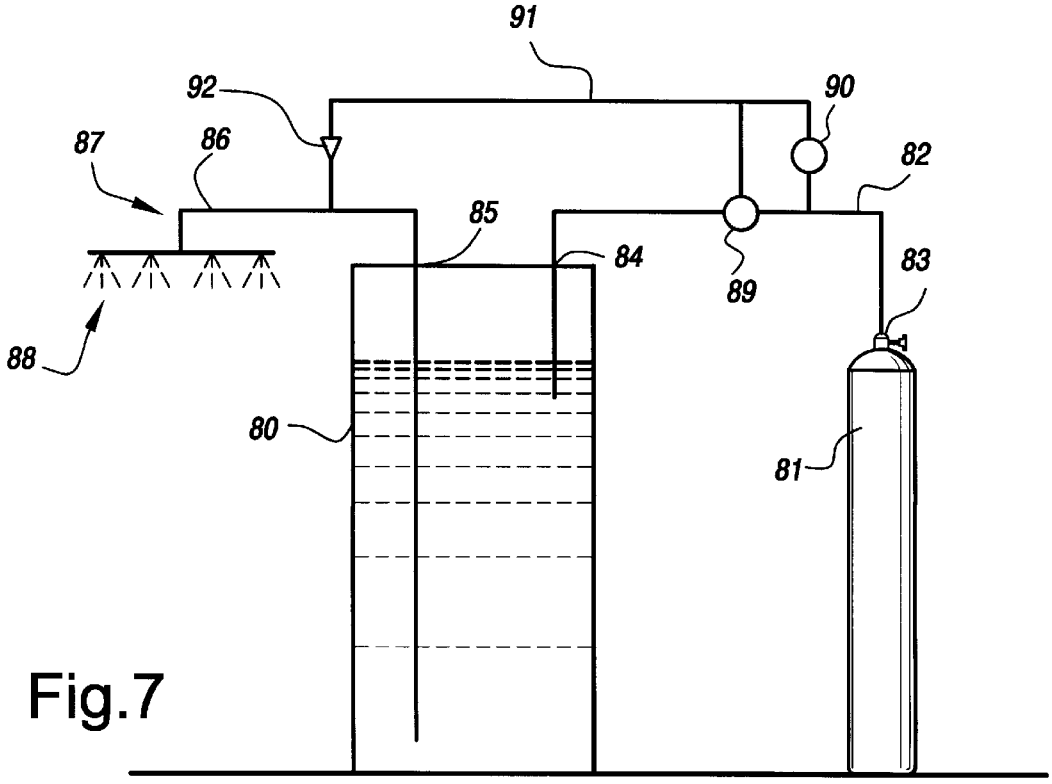

FIG. 7 discloses a variation of the embodiment of FIG. 6. As shown in FIG. 7, the apparatus comprises a low pressure vessel 80, a high pressure vessel 81, and a conduit 82 to enable selective fluid communication between vessels 80 and 81 Conduit 82 is connected at one end to a valve 83 on high pressure gas cylinder 82 and at its other end to inlet port 84 having an opening preferably near the top of pressure vessel 80. Supply conduit 85 is in fluid communication with the interior of vessel 80 and is connected via conduit 86 to a reticulation system 87 having a plurality of discharge nozzles 88.

A diaphragm valve 89 is biased to a normally closed position by a low gas pressure maintained in conduit 86 by a pressure reducing valve 90 in a branch conduit 91 extending from the high pressure side of valve 89 to conduit 86. Valve 89 is biased to a normally closed position by the low pressure gas in conduit 91. A one way check valve 92 is provided in conduit 91 to prevent back flow of pressurized fluid from vessel 80.

Discharge nozzles 88 are biased to a normally closed position by thermally fusible elements (not shown) of a conventional type. In the event of fire, one or more of the fusible elements melt or explode to open a respective nozzle. The subsequent reduction in gas pressure within conduit 86 then allows valve 89 to open to evacuate liquid $CO_2$ from vessel 86 in the manner described with reference to FIG. 6.

A particular advantage of this system is that liquid $CO_2$ is delivered only to the area in which a fire is detected.

In yet a further modification, the apparatus generally shown in FIG. 7 may comprise a low pressure vessel 80 containing water or an aqueous solution which may additionally include soluble or suspended fire retardant chemicals. Nozzles 88 may be liquid distributing nozzles adapted to spray liquid evenly over a given surface area. The application of water is restricted to the immediate area of the fire; and also as the volume of water is limited, the extent of water damage normally associated with water sprinklers is contained.

Pressurized gas cylinder 81 may contain an excess of pressurized gas such that after the fire region is doused with water, a further smothering blanket of $CO_2$ is released into that area to contain any further outbreak. The high pressure gas cylinder may comprise compressed air, or any inert fire retarding gas such as $CO_2$, nitrogen, argon, or synthetic fire retarding gases.

Figure 8:
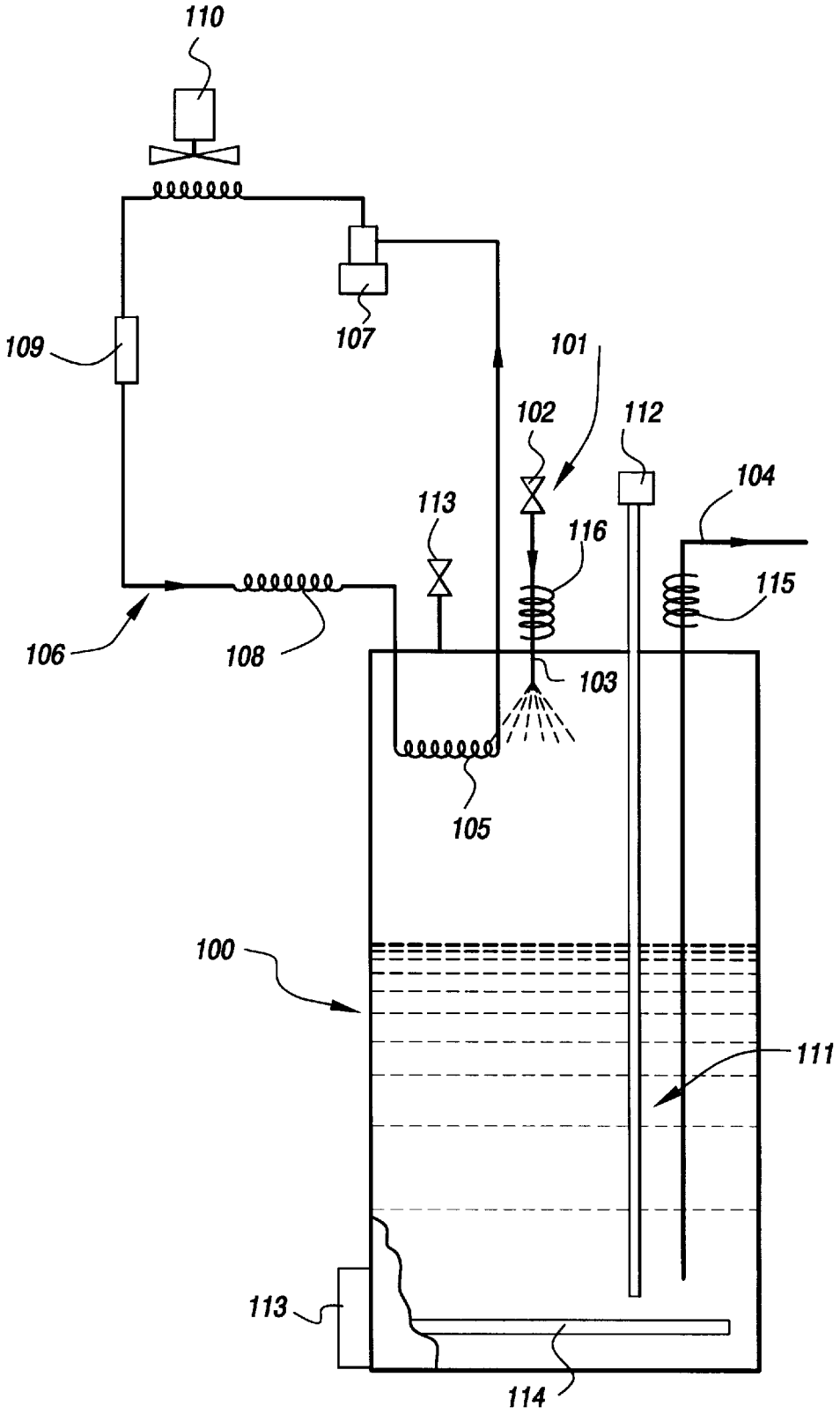
FIG. 8 is a diagrammatic view of an apparatus according to a further embodiment of the invention.

FIG. 8 refers to a further embodiment of the apparatus. In this figure, there is disclosed a pressure vessel 100 for storing and supplying liquid $CO_2$ at low pressure. Pressure vessel 100 is insulated (not shown). The vessel has an inlet means 101 for filling vessel 100 with liquid $CO_2$ and which comprises an inlet valve 102 and an inlet conduit 103 which passes through a top wall in vessel 100 to an upper position in the tank normally occupied by gas. The pressure vessel further comprises a supply conduit 104 extending through the top wall of vessel 100 and to adjacent the bottom wall of vessel 100. Located within an upper part of vessel 100 is a cooling means in the form of a refrigerant evaporator 105 connected in circuit with a conventional refrigeration system showing generally 106 and comprising a compressor 107, capillary 108, dryer/filter 109, and condenser 110. Inlet conduit 103 is positioned such that incoming $CO_2$ is sprayed over or contacts evaporator 105.

A liquid level indicating means in the form of a probe 111 locates within pressure vessel 100 and extends to adjacent the bottom wall thereof and is coupled to a readout 112 to indicate the liquid level. A pressure relief valve 113 is fitted to the top wall of vessel 100 to vent any excess pressure beyond the predetermined limit.

A pressure actuable switch (not shown) is operable when a predetermined pressure is reached within vessel 100 to actuate the refrigeration system 106 to cool the gaseous $CO_2$ at the top of vessel 100 and thereby reduce the pressure within the vessel to a predetermined level at which the refrigeration system is switched off. A heating element 113 is provided and comprises a closed off tube 114 extending across the interior of the vessel with a heating element (not shown) located within the closed off tube. In this manner, the element can be remove, from the tube for inspection or replacement in a simple manner. The heating element can be actuated to maintain the liquid $CO_2$ within predetermined pressure and temperature limits.

A further heating element 115 may be located about supply conduit 104 during heavy discharge rates and a further cooling element 116 may be located about inlet 103 to further cool incoming $CO_2$ for filling purposes.

Figure 9:
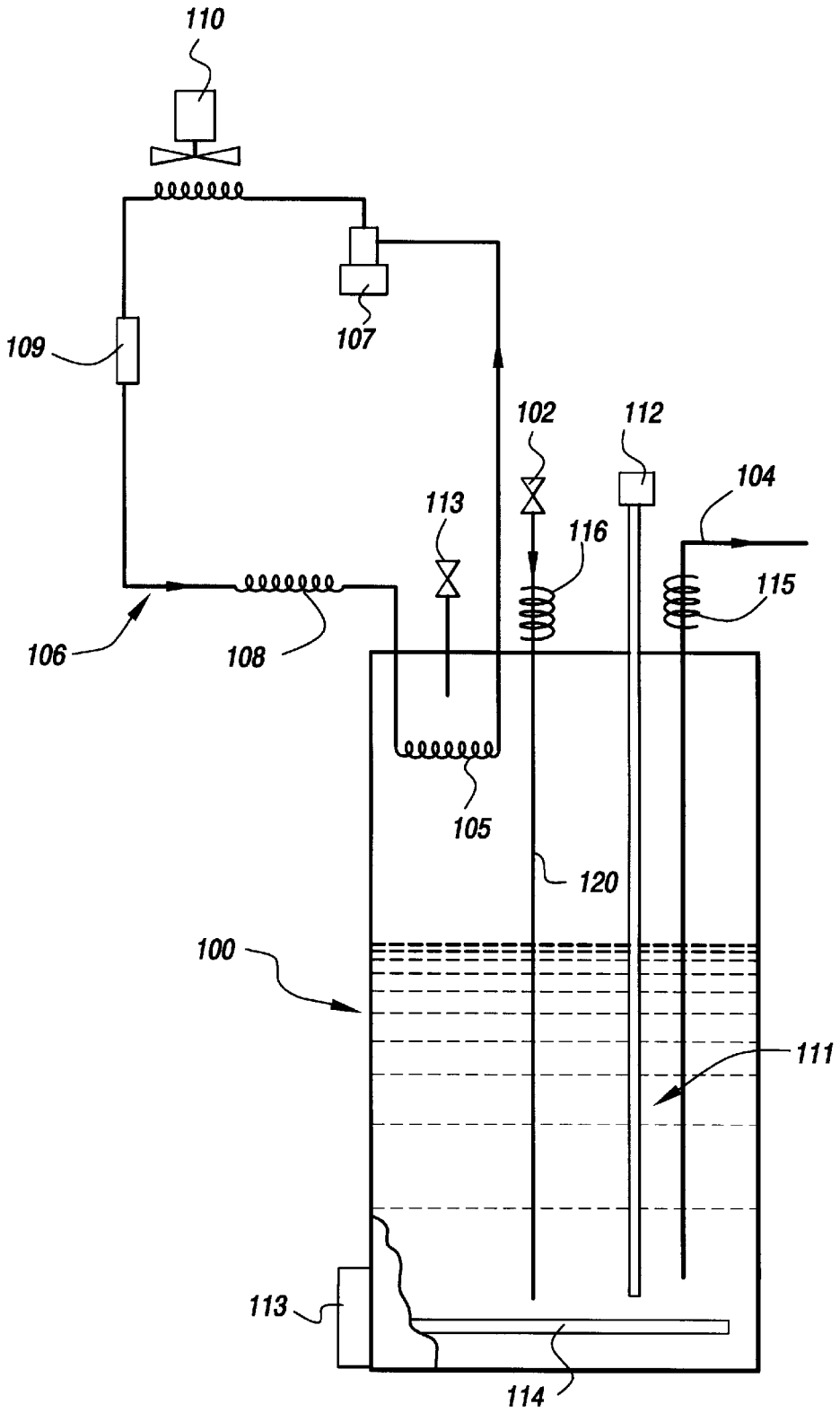
FIG. 9 is a diagrammatic view of an apparatus according to a further embodiment of the invention.

FIG. 9 discloses a modification to the apparatus of FIG. 8 where the inlet means comprises a conduit 120 extending through the top wall of pressure vessel 100 to adjacent the bottom wall thereof. In this manner, incoming $CO_2$ percolates through the liquid $CO_2$ within vessel 100 and is cooled thereby. The outlet means as in FIG. 8 can comprise part of pressure valve 113.

Figure 10:
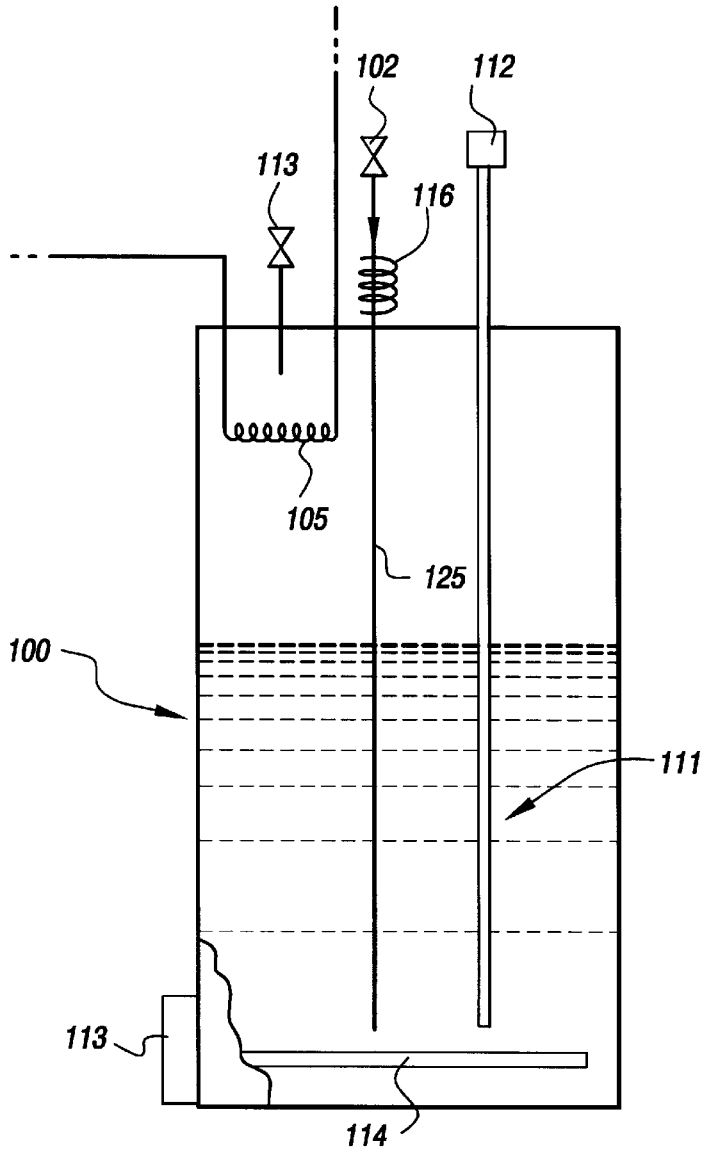
FIG. 10 is a diagrammatic view of apparatus according to a further embodiment of the invention.

FIG. 10 discloses a further embodiment of the apparatus wherein the inlet means for filling the vessel and the supply conduit for supplying liquid $CO_2$ are combined to form a common conduit 125. This minimizes the requirement for drilling or otherwise forming openings within vessel 100.

Figure 11:
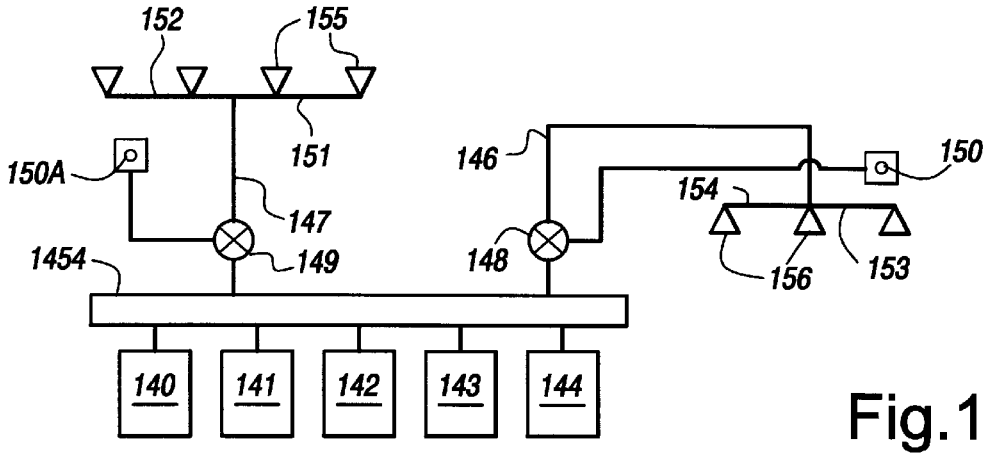
FIG. 11 is a schematic view of a fire extinguishing system according to an embodiment of the invention.

FIG. 11 discloses a fire extinguishing system comprising a plurality of pressure vessels 140–144 for storing and supplying liquid $CO_2$ at low pressure. Each of pressure vessels 140–144 is connected to a manifold 145 and permanently pressurizes manifold 145 with $CO_2$. If supply valves are provided between a pressure vessel and the manifold, the supply valve is left in a fully opened position. Coupled to manifold 145 are two separate conveying conduits 146, 147 which are coupled to manifold 145 through manifold valves 148, 149. Valves 148, 149 are operable by sensors 150, 150A located in or adjacent a risk site. A number of secondary conduits 151–154 extend from conveying conduit 146, 147 and include a plurality of discharge nozzles 155, 156.

In the event of fire in either of the risk sites, the respective sensor 150, 150A activates its respective valve 148, 149 which in turn results in pressure vessels 140–144 exhausting their contents through manifold 145 and conveying conduit 146 (or 147) and through discharge nozzles 155 or 156.

Figure 12:
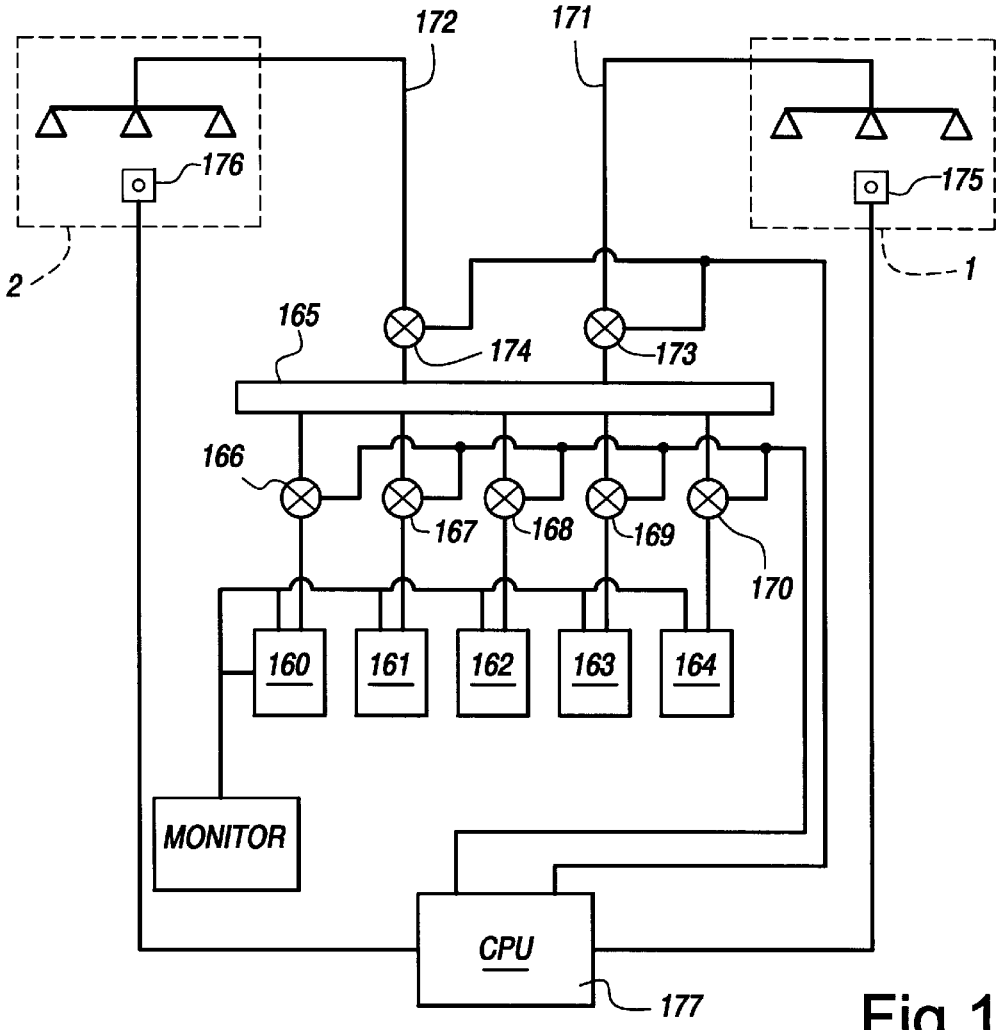
FIG. 12 is a schematic view of a fire extinguishing system according to another embodiment of the invention.

FIG. 12 shows an improved version of the system of FIG. 11. In this Figure, a plurality of pressure vessels 160–164 are connected to a common manifold 165 through individual supply valves 166–170. As with FIG. 11, one or more (FIG. 12 discloses two) conveying conduits 171, 172 are coupled to manifold 165 through manifold valves 173, 174 and are associated with a $CO_2$ reticulation system similar to that disclosed in FIG. 11. A sensor 175, 176 is located in or adjacent each risk site and is connected to a central computer in the form of a logic processor 177. Logic processor 177 can operate each individual supply valve 166–170 and each manifold valve 173, 174.

Upon a fire being detected in a risk site, a respective sensor sends a signal to the logic processor 177. Logic processor 177 computes (or has in its memory storage) the volume of the respective risk site and actuates one or more of the pressure vessels 160–164 and a respective manifold valve 173, 174 to direct a correct quantity of liquid $CO_2$ to the risk site.

This system has the advantage that not all pressure vessels need to be used or exhausted at the same time thereby allowing exhausted pressure vessels to be refilled while having fully charged pressure vessels in reserve in case of a fire being detected during a filling operation of certain of the pressure vessels. Any leaks or damage to a pressure vessel causing escape of liquid $CO_2$ from that vessel will not result in compromising the $CO_2$ contents of any other vessel (as the case is with the system of FIG. 11). In a modification, the discharge nozzles may comprise a fusible element and upon a fire being sensed by one or more discharge nozzle, a signal is sent to logic processor 177 which computes the exact amount of liquid $CO_2$ to be discharged to that particular nozzle. It should also be appreciated that pressure vessels 160–164 need not be of the same capacity and may include pressure vessels of differing capacities (such as 525 kg, 300 kg, and 150 kg) with the logic processor being able to selectively open the supply valves of any particular vessel thereby ensuring a proper supply of liquid $CO_2$ to a risk site upon detection of a fire.

Figure 13:
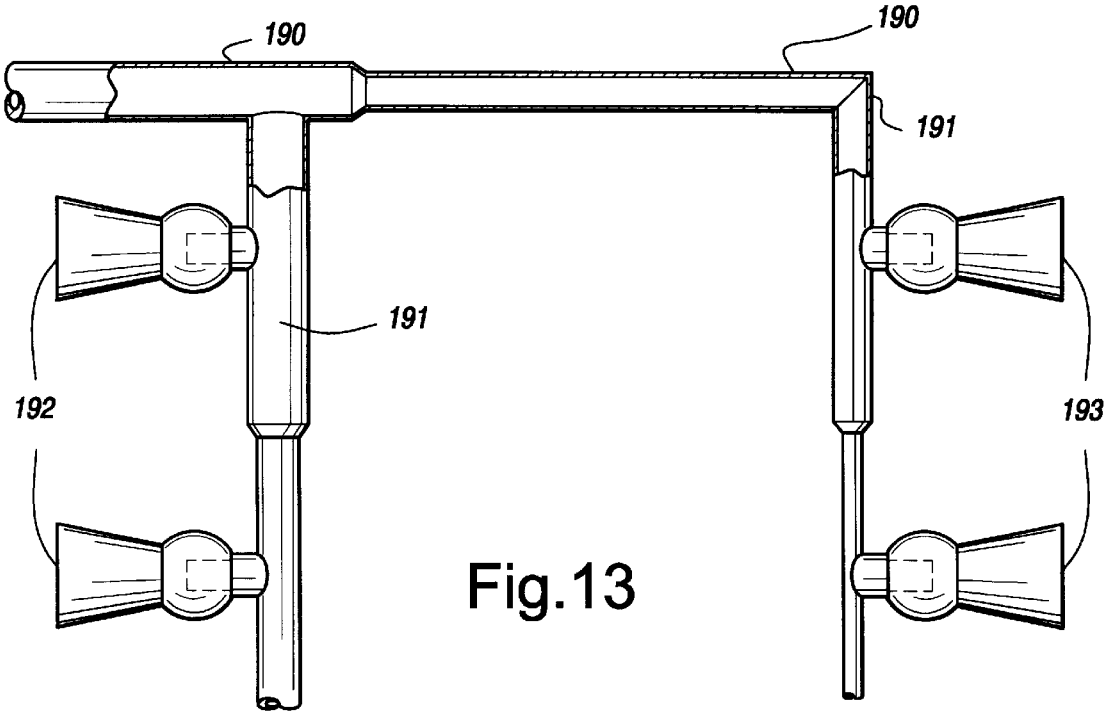
FIG. 13 is a schematic view of a typical conveying conduit including a plurality of discharge nozzles.

FIG. 13 shows a portion of a particular conduit system comprising a primary conduit 190 to convey $CO_2$ from a pressure vessel toward a risk site and a plurality of secondary conduits 191 extending from primary conduits 190 and containing discharge nozzles 192, 193.

Primary conduit 190 decreases in cross-sectional area after a first secondary conduit has branched from it to ensure a constant pressure within the conduit. Similarly, a respective secondary conduit decreases in cross-section after one or more attached discharge nozzles to provide each nozzle with approximately equal discharge pressure. The area of reduced cross-section comprise pipes of different diameter which are coupled together through a suitable reduction coupling (not shown).

Figure 14:
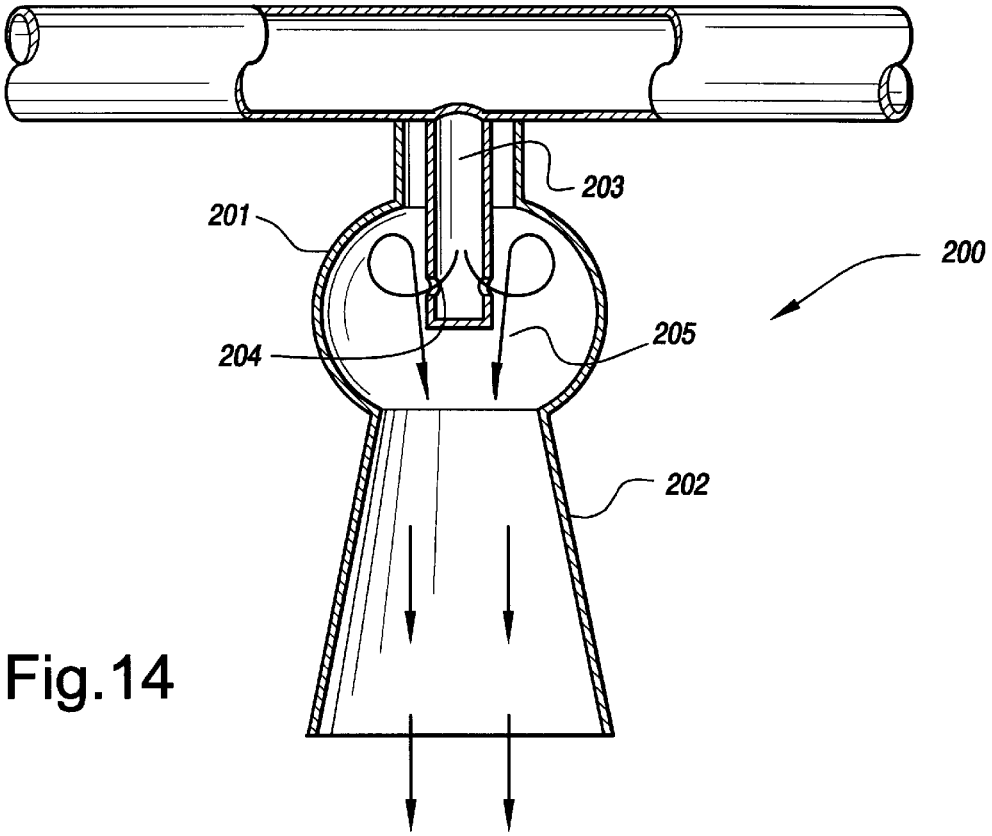
FIG. 14 is a section view of a preferred discharge nozzle.

FIG. 14 shows a suitable discharge nozzle for use in a fire extinguishing system. The nozzle 200 comprises an upper substantially spherical body 201 and a lower substantially conical outlet 202. Upper body 201 is connected to a secondary conduit (or primary conduit) in any suitable manner and a hollow spigot 203 communicates with the interior of the conduit and extends to a point approximately midway through spherical body 201. Spigot 203 includes a plurality of lower openings 204 through which the liquid $CO_2$ exits in a substantially lateral fashion. The $CO_2$ contacts an internal wall of body 201 and assumes a pathway generally shown by arrows 205 to exit from lower outlet 202.

FIG. 15 discloses a layout for converting an existing halon system to a liquid $CO_2$ system.

The room size (risk site) is 12 m×5.6 m×2.4 m=161.3 $m^3$.

The National Fire Protection Agency code 12-2.4.2 (NFPA 12-2.4.2) requires a $CO_2$ quantity of 1.22 kg/$m^3$ which requires a total $CO_2$ amount of 215 kg.

The code requires the amount to be discharged within 7 minutes requiring a discharge rate of 30.65 kg/min. (67.5 lb/min.)

Each nozzle has a discharge rate of 15.35 kg/min.

The pipe lengths of the system are as follows:

| | | | | |
|---|---|---|---|---|
| Section | 1–2 | 8 ft | Elevation of Pipe 6 ft | + valve + 2 elbows |
| | 2–3 | 42 ft | 6 ft | + 6 elbows |
| | 3–4 | 2 ft | 2 ft | + Tee |
| | 3–5 | 20 ft | 2 ft | + elbow |

Using NFPA 12 Table A-1-10.5(e), the equivalent length sections of a specific pipe will be:

| | | | |
|---|---|---|---|
| Equivalent Length Section | 1–2 | 15 ft | 4.6 m |
| | 2–3 | 53ft | 16.15 m |
| | 3–4 | 5 ft | 1.5 m |
| | 3–5 | 22 ft | 6.7 m |

Using NFPA 12 Table A-1-10.5(f)

| | |
|---|---|
| Elevation Correction | .443 psi/ft @ 300 psi<br>.343 psi/ft @ 280 psi<br>.265 psi/ft @ 260 psi |

From NFPA 12 1-10.5.1

$$Q^2 = \frac{3647\, D^{5.25} Y}{L + 8.08\, D^{1.25} Z}$$

For Section 2-3 with input pressure of 280 psi, from Table A-1-10.5(a), Y=1119, Z=0.264

$$Q^2 = \frac{3647 \times 1.380^{5.25} \times 1119}{53 + (8.08\ 1.380^{1.25} \times .264)}$$

$$Q^2 = \sqrt{393974.2615}$$

$$= 627.7 \text{ lb/min.}$$

Assume discharge rate of (say) 450 lb/min.

| | Section 1–2 | Section 2–3 | Section 3–4 | Section 3–5 |
|---|---|---|---|---|
| $\frac{L}{D^{1.25}}$ = | $\frac{15}{2.475}$ | $\frac{53}{1.496}$ | $\frac{5}{1.062}$ | $\frac{22}{1.062}$ |
| = | 6.1 | 35.4 | 4.71 | 20.72 |
| $\frac{Q}{D^2}$ = | $\frac{450}{4.272}$ | $\frac{450}{1.904}$ | $\frac{225}{1.1}$ | $\frac{225}{1.1}$ |
| = | 105 | 236 | 205 | 205 |

From curves in A1-10.5 A

Pressure drop in Section 1-2=2 psi
Term pressure Section 1-2=298 psi
Term pressure Section 2-3=290 psi
Term pressure Section 3-4=288 psi Nozzle 1
Term pressure Section 3-5=283 psi Nozzle 2
Pressure at Nozzle 1=288 psi=2795 lb/min/$In^2$
Required Flow Rate=225 lb/min
Nozzle Orifice=0.0805 $In^2$=5/16" DIA Approx. (No. 10 Orifice)
Pressure at Nozzle 2=283 psi=2535 lb/min/$In^2$
Required Flow Rate=225 lb/min.
Nozzle Orifice=0.0888 $In^2$=5/16" DIA Approx. (No. 10 Orifice)

The fire extinguishing system according to the invention can use the identical pipework currently used with halon extinguishing systems although it is preferred that the normal halon discharge nozzles are replaced with those illustrated in FIG. 14. In contrast, high pressure $CO_2$ systems cannot be directly coupled to halon pipework as the halon pipework operates at low pressure similar to that of low pressure $CO_2$.

The apparatus of the invention is fully self-contained, and is portable allowing it to be moved and positioned at any desirable location within a building and not necessarily on a ground floor or outside the building. A unit storing 500 kg of $CO_2$ takes up approximately the same space of a large domestic refrigerator and does not require any strengthening of the floor on which the unit is positioned. Thus, the unit can be positioned immediately adjacent a risk site thereby saving on the length of conduit required in the risk site.

Any number of units can be connected together through a common manifold and the unit can be of various sizes to allow any amount of liquid $CO_2$ to be discharged into a risk site.

Alternatively, separate units can be used for separate risk sites thereby doing away with the need for a complicated interconnecting system of pipework.

If a risk site is increased in size, additional units can be coupled to the existing units or a larger unit can be substituted for the existing unit with the minimum of cost or downtime. Alternatively, if a risk site is reduced in size, the unit can be simply replaced with a smaller unit.

The units are preferably equipped with an array of alarms and sensors to continuously monitor power status, internal pressure, and liquid level within the pressure vessel and any variation of the power status, internal pressure, or liquid level can set off an alarm or a signal can be sent to a remote station to allow inspection of the vessel.

It should be appreciated that various other changes and modifications may be made to the embodiments described without departing from the spirit and scope of the invention as defined in the appended claims.

We claim:

1. A fire extinguishing system for storing and supplying a correct amount of liquid $CO_2$ at low pressure to at least two risk sites, said system comprising:

two or more low pressure vessels, each pressure vessel of said two or more pressure vessels including a supply conduit for supplying the liquid $CO_2$, said supply conduit extending into a lower portion of said pressure vessel, inlet means for filling said pressure vessel, and cooling means for cooling the liquid $CO_2$ stored in said pressure vessel;

a manifold coupled to said two or more pressure vessels, said manifold being in fluid communication with each of said supply conduits;

a conveying conduit for conveying the liquid $CO_2$ from said manifold to each of said at least two risk sites;

at least one risk site sensor located in each of said at least two risk sites;

one or more discharge nozzles coupled to each of said conveying conduits for discharging the liquid $CO_2$ conveyed therein;

one or more pressure vessel sensors to sense variations from one or more predetermined operational parameters of said two or more pressure vessels;

two or more valves actuable in response to operation of said at least one risk site sensor at any of said at least two risk sites to release a flow of the liquid $CO_2$ into respective said conveying conduits, and wherein, in use, any of said two or more valves is selectively operable upon activation of said at least one risk site sensor at any of said at least two risk sites; and computing means coupled to said risk site sensors and said valves for selective direction to at least one of said at least two risk sites from any one or more of said low pressure vessels the correct amount of the liquid $CO_2$ for said at least one of said at least two risk sites, said selective direction being controlled by said computing means as a function of risk site volume.

2. A fire extinguishing system as claimed in claim 1 wherein the operational parameters of said two or more pressure vessels are selected from internal pressure, liquid level, or power status or any combination thereof.

3. A fire extinguishing system as claimed in claim 1 wherein said pressure vessel sensors are coupled to a central computing means.

4. A fire extinguishing system as claimed in claim 1 further including remote monitoring means for signals emitted by said pressure vessel sensors.

5. A fire extinguishing system as claimed in claim 1 wherein each said cooling means is in gaseous communication with the liquid $CO_2$in said pressure vessel thereof.

6. A fire extinguishing system as claimed in claim 1 wherein said two or more valves comprise supply valves.

7. A fire extinguishing system as claimed in claim 1 wherein said two or more valves comprise manifold valves.

8. A fire extinguishing system as claimed in claim 1 wherein at least one of said two or more valves comprises a supply valve located between said manifold and a respective said pressure vessel and at least one of said two or more valves comprises a manifold valve located in a respective said conveying conduit.

* * * * *